US010602799B2

(12) United States Patent
Chalk, Jr. et al.

(10) Patent No.: US 10,602,799 B2
(45) Date of Patent: Mar. 31, 2020

(54) ATHLETIC SHOE WITH ENERGY RETURN SYSTEM

(71) Applicant: NFINITY IP, LLC, Atlanta, GA (US)

(72) Inventors: F N Chalk, Jr., Atlanta, GA (US); Stephen David Opie, Arlington, MA (US); James Tsen, Needham, MA (US)

(73) Assignee: NFINITY IP, LLC, Atlanta, GA (US)

( * ) Notice: Subject to any disclaimer, the term of this patent is extended or adjusted under 35 U.S.C. 154(b) by 647 days.

(21) Appl. No.: 14/678,570

(22) Filed: Apr. 3, 2015

(65) Prior Publication Data

US 2016/0000181 A1 Jan. 7, 2016

Related U.S. Application Data

(60) Provisional application No. 61/974,630, filed on Apr. 3, 2014.

(51) Int. Cl.

| | |
|---|---|
| ***A43B 7/14*** | (2006.01) |
| ***A43B 13/18*** | (2006.01) |
| ***A43B 13/16*** | (2006.01) |
| ***A43B 13/12*** | (2006.01) |

(52) U.S. Cl.

CPC ..... *A43B 7/1465* (2013.01); *A43B 7/148* (2013.01); *A43B 13/127* (2013.01); *A43B 13/16* (2013.01); *A43B 13/188* (2013.01)

(58) Field of Classification Search

CPC ..... A43B 7/1465; A43B 7/148; A43B 13/127; A43B 13/16; A43B 13/186; A43B 5/10; A43B 7/1415–7/145; A43B 7/1485; A43B 13/023; A43B 13/018; A43B 13/181; A43B 13/187

USPC ..... 36/28, 30 R, 30 A, 31

See application file for complete search history.

(56) References Cited

U.S. PATENT DOCUMENTS

| | | | | |
|---|---|---|---|---|
| 5,367,791 | A * | 11/1994 | Gross | A43B 13/181 36/25 R |
| 6,412,196 | B1 * | 7/2002 | Gross | A43B 13/026 36/102 |
| 7,343,701 | B2 * | 3/2008 | Pare | A43C 1/06 36/50.1 |
| 7,523,566 | B2 * | 4/2009 | Young-Chul | A43B 13/12 36/28 |

(Continued)

*Primary Examiner* — Anna K Kinsaul
*Assistant Examiner* — F Griffin Hall
(74) *Attorney, Agent, or Firm* — Thomas|Horstemeyer, LLP

(57) ABSTRACT

An athletic shoe with an energy return system is provided. The shoe includes a shoe sole assembly having a midsole, at least one stabilizer plug in a recess in the midsole, and at least one outsole member. In an aspect, the stabilizer plug has at least one trampoline recess disposed in an upper surface thereof, and at least one projection extending from a lower surface thereof that substantially underlies at least a portion of the at least one trampoline recess. An upper surface of the outsole is adapted to complimentarily receive the at least one projection extending from the lower stabilizer plug surface such that when a force is applied to the lower outsole surface during a foot strike, the at least one trampoline recess receives underlying portions of the stabilizer plug to accommodate elastic deflection of the underlying portions of the stabilizer plug and the outsole.

19 Claims, 16 Drawing Sheets

(56) References Cited

U.S. PATENT DOCUMENTS

| | | | | |
|---|---|---|---|---|
| 8,307,569 | B2 * | 11/2012 | McInnis | A43B 3/0005 36/114 |
| 2002/0148142 | A1 * | 10/2002 | Oorei | A43B 5/00 36/129 |
| 2004/0134097 | A1 * | 7/2004 | Russell | A43B 7/1415 36/29 |
| 2010/0005684 | A1 * | 1/2010 | Nishiwaki | A43B 7/1425 36/28 |
| 2010/0031530 | A1 * | 2/2010 | Abshire | A43B 21/26 36/28 |
| 2011/0185590 | A1 * | 8/2011 | Nishiwaki | A43B 5/06 36/28 |
| 2013/0031804 | A1 * | 2/2013 | Abshire | A43B 7/1425 36/103 |
| 2013/0104419 | A1 * | 5/2013 | Horesh | A43B 7/1425 36/43 |
| 2014/0325871 | A1 * | 11/2014 | Price | A43B 13/18 36/28 |

* cited by examiner

ATHLETIC SHOE WITH ENERGY RETURN SYSTEM

CROSS-REFERENCE TO RELATED APPLICATION

This application claims priority to U.S. Provisional Patent Application No. 61/974,630 filed on Apr. 3, 2014, which is hereby incorporated by reference in its entirety.

BACKGROUND OF THE INVENTION

The Field of the Invention

Implementations described herein relate generally to an athletic shoe, and more particularly, to a shoe sole assembly having an energy return system as well as methods for making the same.

Background

Athletic shoes are a necessary element for enhancing performance in virtually every athletic endeavor. Such footwear is customized to the particular sport or undertaking, spanning the gamut from walking, where an athlete is on their feet, to automobile racing, where an athlete is seated. For whatever sport, a particular emphasis is placed on enhancing performance. Considering basketball shoes as an example, footwear has been developed that includes expedients to help the player run faster, jump higher, more rapidly shift direction and so on.

One of the more demanding athletic pursuits is cheerleading. Current day cheerleading is a rigorous sport that involves strenuous aerobic activity, gymnastics, strength, and stamina. The range of activities requires and the sport itself ranges from familiar "sideline" activities to large group competitions between cheerleading squads.

It is only recently that the sport of cheerleading has received attention from athletic shoe designers and manufacturers. The physical demands of this sport, in particular, require footwear that is supportive for movement in multiple directions, that is comfortable through long hours of practice and performances, and that provides effective cushioning for the, at times, severe impacts to which the athlete's feet are subjected.

Accordingly, a need exists for improved shoes and methods for manufacturing shoes that accommodate the physical demands of cheerleading.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, the present disclosure provides for a shoe sole assembly having trampoline-effect energy return system. More particularly, the shoe sole assembly comprises a midsole, at least one stabilizer plug, and at least one outsole member. In another aspect, the midsole has an upper midsole surface, a lower midsole surface, a midsole forefoot portion and a midsole heel portion. In another aspect, the at least one stabilizer plug has an upper stabilizer plug surface, a lower stabilizer plug surface, and at least one trampoline recess disposed in the upper stabilizer plug surface. In another aspect, the stabilizer plug can have at least one projection extending outwardly from the lower stabilizer plug surface relative to the vertical axis and, in a further aspect, each projection of the at least one projection can substantially underlie at least a portion of the at least one trampoline recess. In another aspect, the at least one outsole member has an upper outsole surface and a lower outsole surface. In another aspect, the at least one outsole member can be adapted to complementarily receive the at least one projection of a corresponding stabilizer plug. In another aspect, the lower midsole surface can define at least one stabilizer plug recess sized and shaped to receive a corresponding at least one stabilizer plug. In operation, when a force is applied to the lower outsole surface during a foot strike, the at least one trampoline recess can receive underlying portions of the stabilizer plug to accommodate elastic deformation of the underlying portions of the stabilizer plug and the outsole relative to the vertical axis. In other aspect, the at least one stabilizer plug can comprise at least one of a forefoot stabilizer plug and a heel stabilizer plug. In another aspect, the at least one outsole member can comprise at least one of a forefoot outsole member and a heel outsole member.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate aspects and together with the description, serve to explain the principles of the methods and systems.

DETAILED DESCRIPTION

Figure 1:
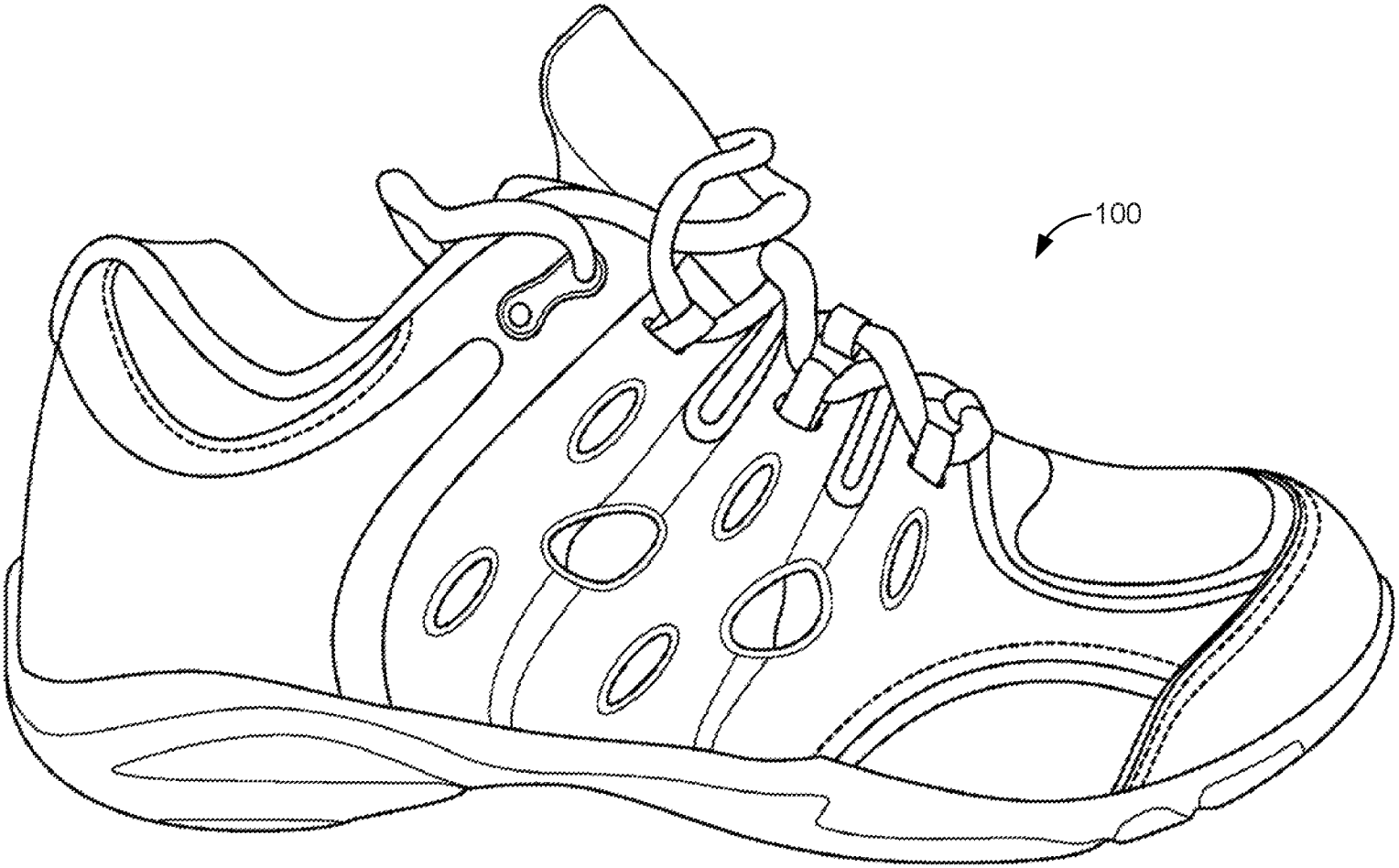
FIG. 1 illustrates a perspective view of one aspect of a shoe according to the present disclosure.
Figure 2:
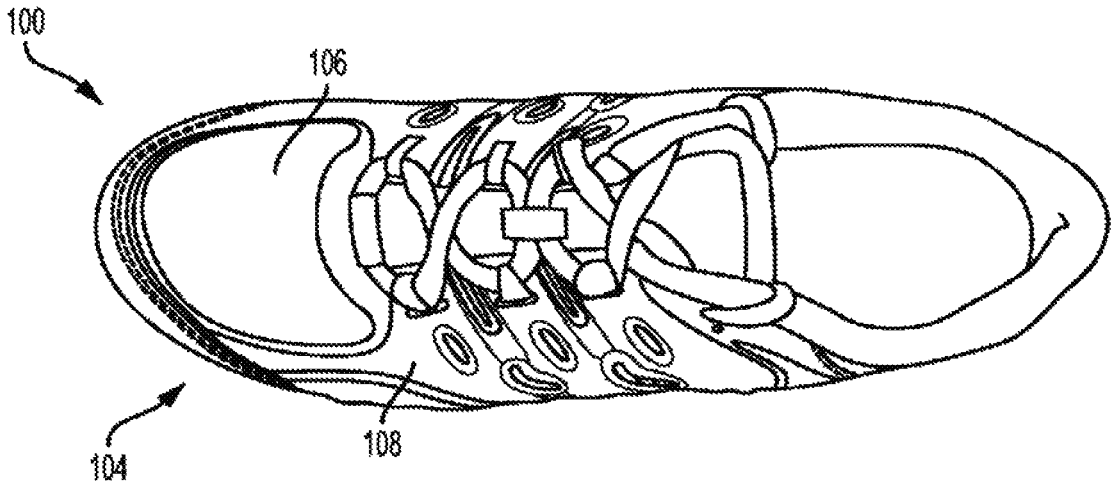
FIG. 2 illustrates a top view of the shoe depicted in FIG. 1.
Figure 3:
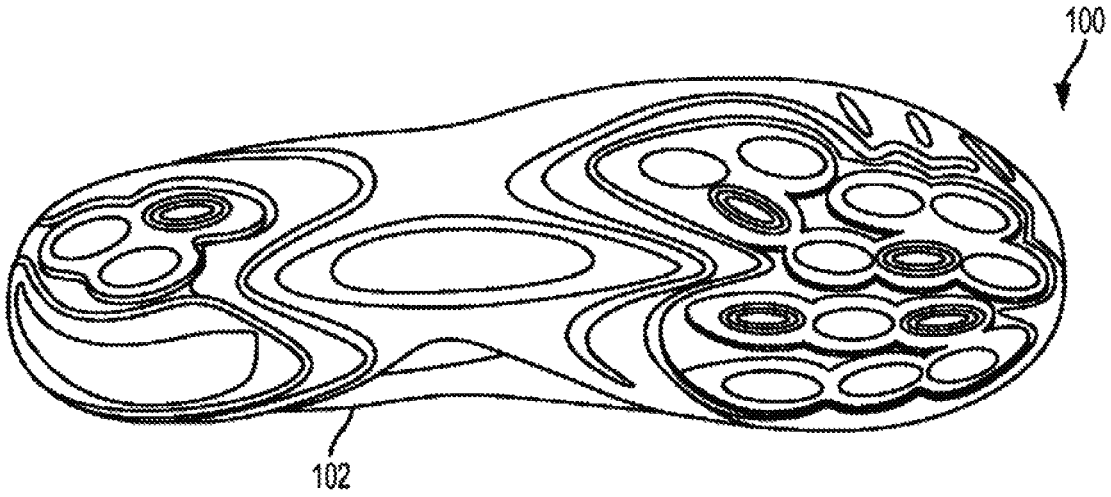
FIG. 3 illustrates a bottom view of the shoe depicted in FIG. 1.
Figure 4:
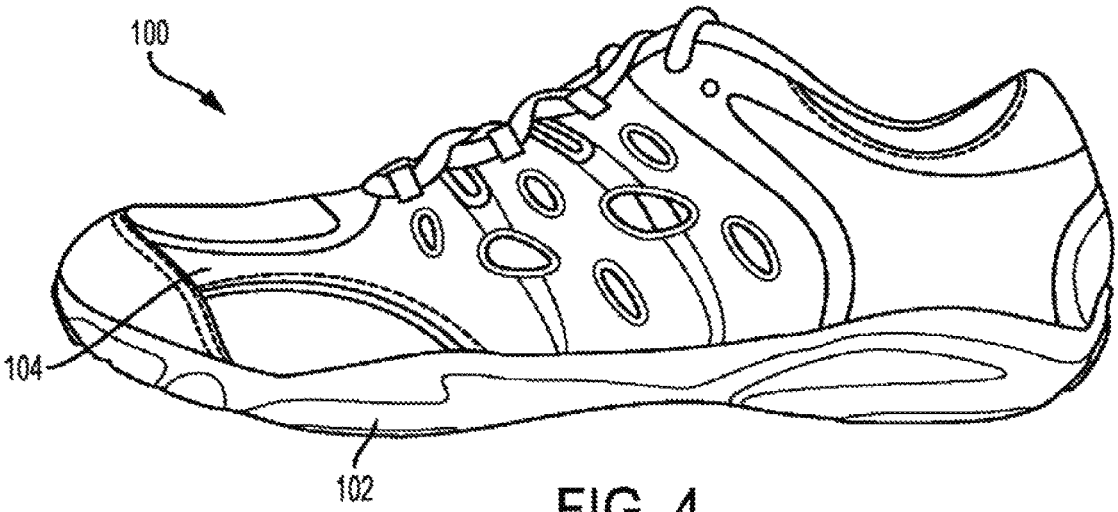
FIG. 4 illustrates a left side view of the shoe depicted in FIG. 1.
Figure 5:
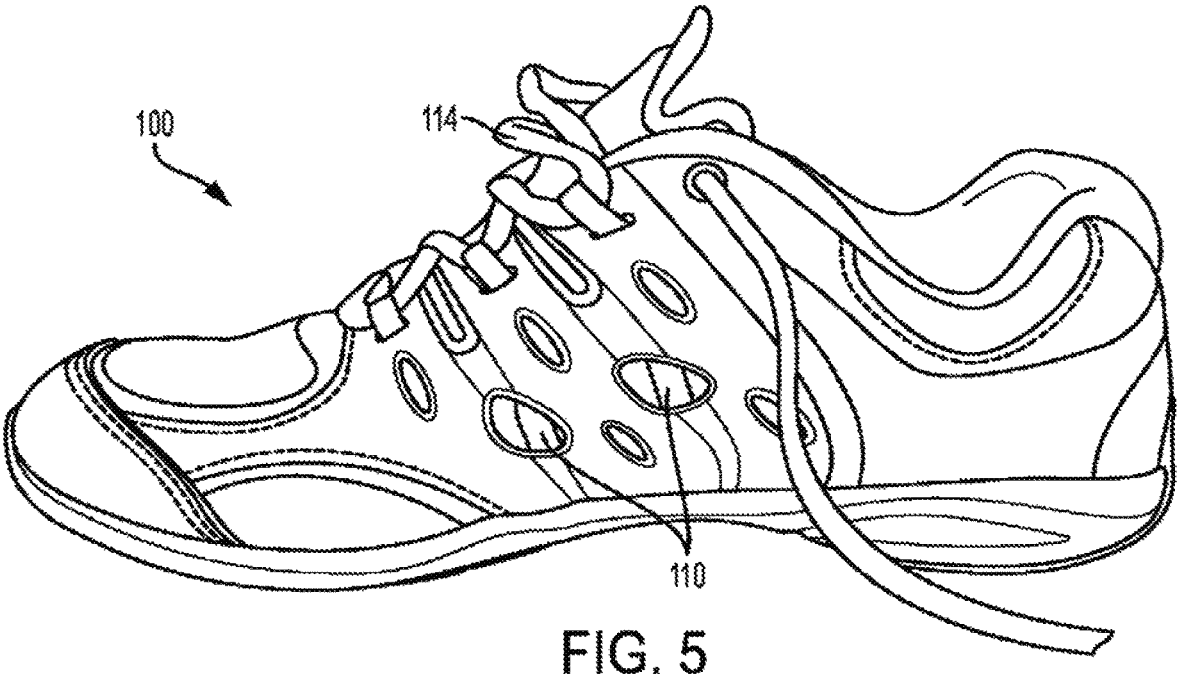
FIG. 5 illustrates a right side view of the shoe depicted in FIG. 1.
Figure 6:
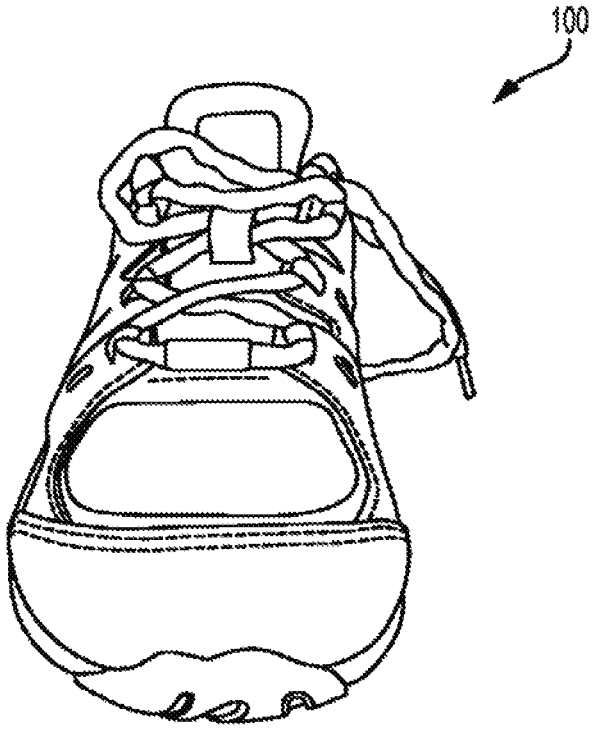
FIG. 6 depicts a front view of the shoe depicted in FIG. 1.
Figure 7:
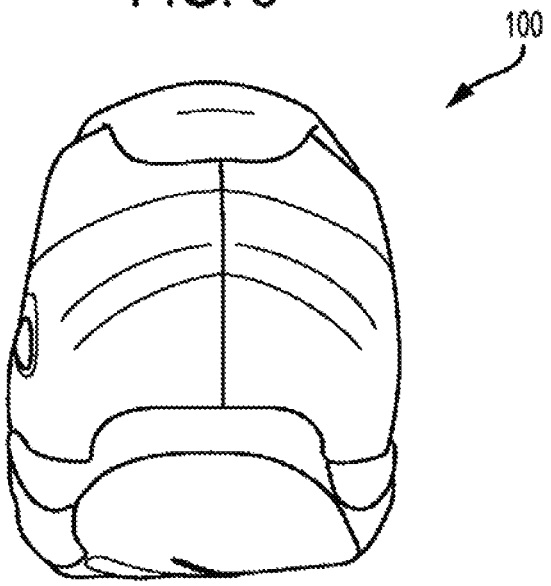
FIG. 7 depicts a back view of the shoe depicted in FIG. 1.
Figure 8:
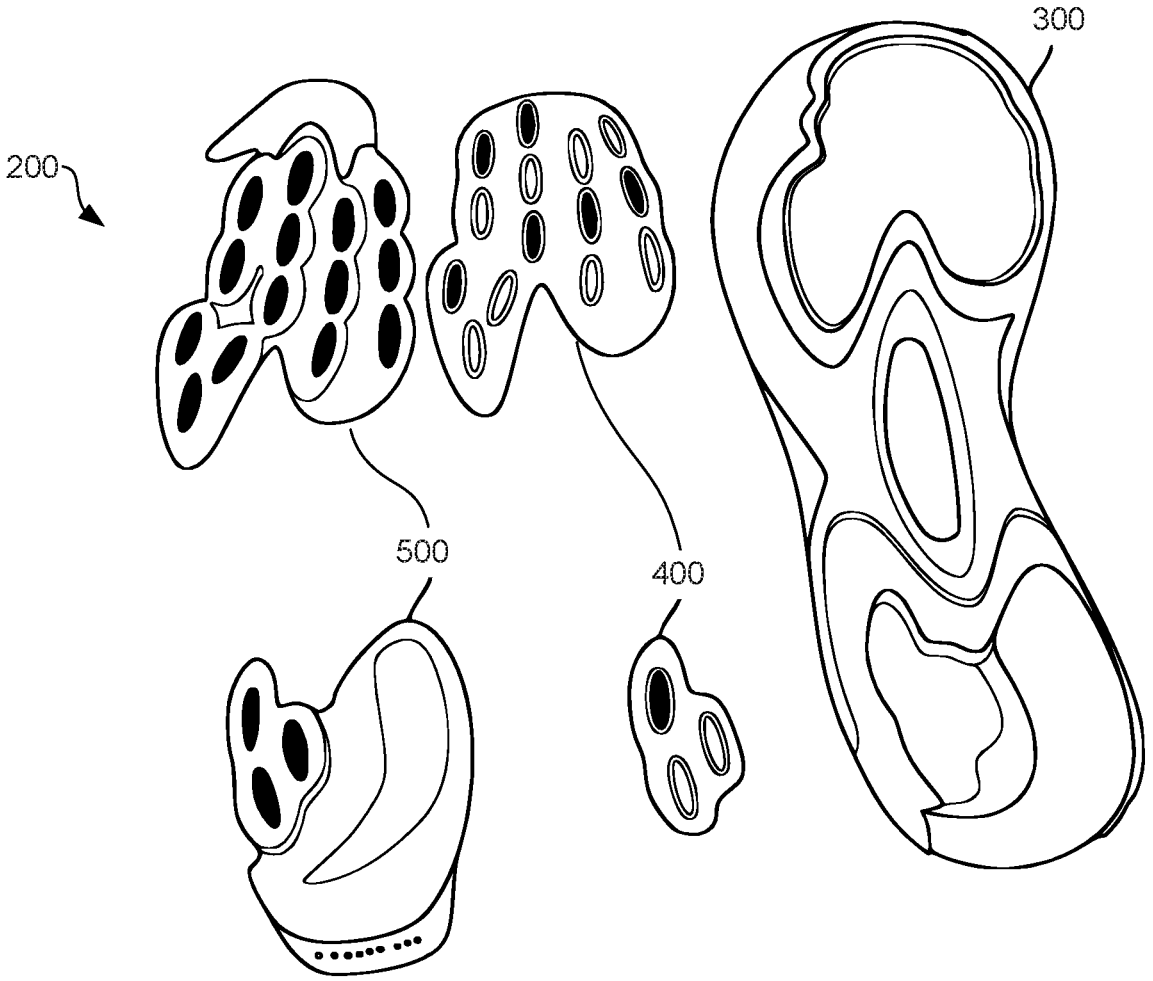
FIG. 8 shows a perspective, exploded view of one aspect of a shoe sole assembly according to the present disclosure.
Figure 9:
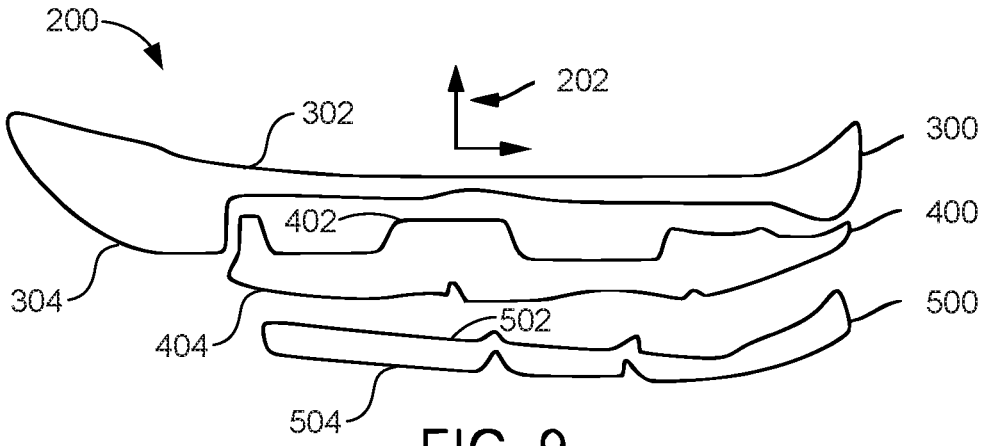
FIG. 9 shows a longitudinal, cross-sectional view of one aspect of a shoe sole assembly according to the present disclosure.
Figure 10:
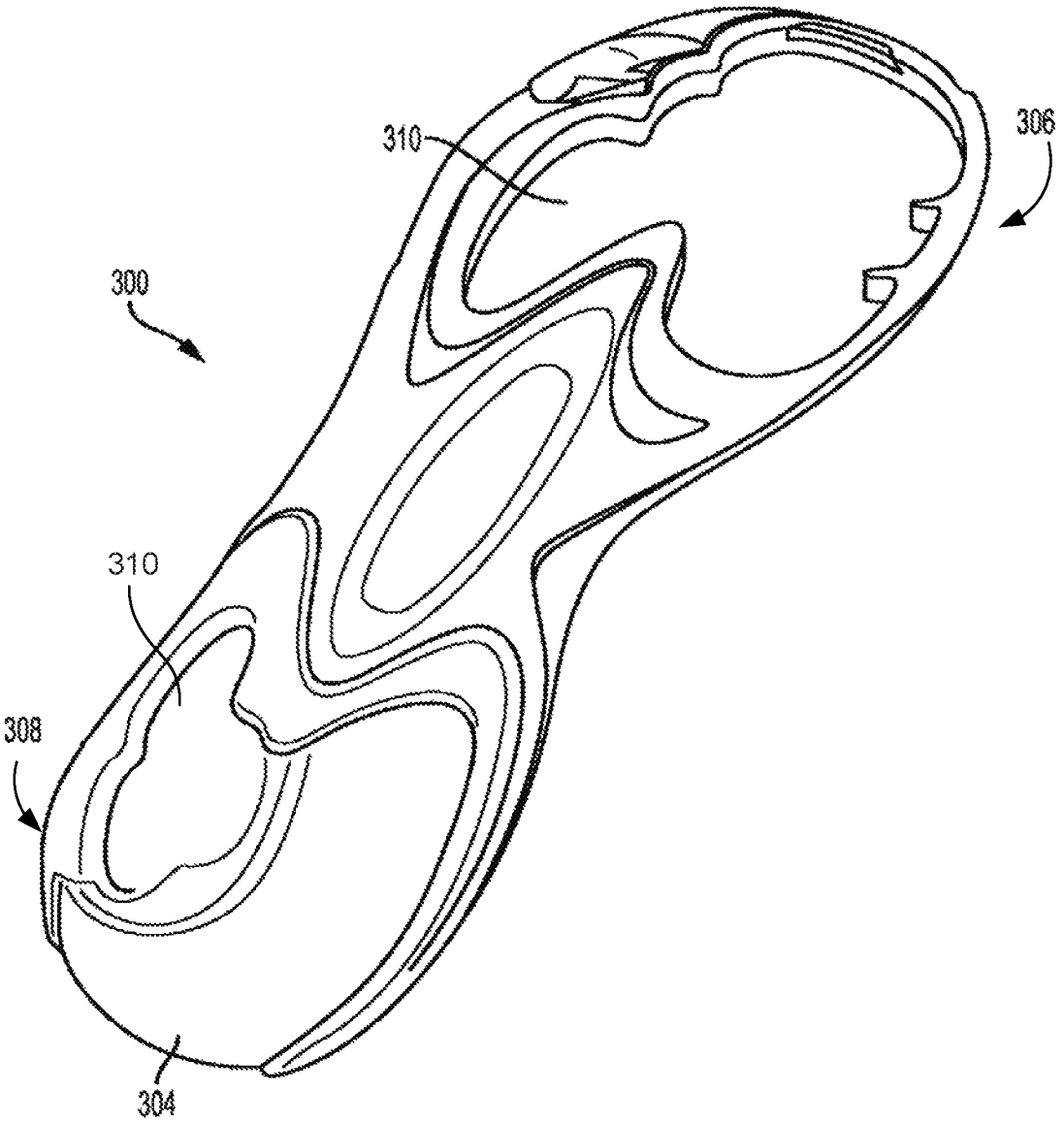
FIG. 10 shows a bottom perspective view of one aspect of the midsole according to the present disclosure.
Figure 11A:
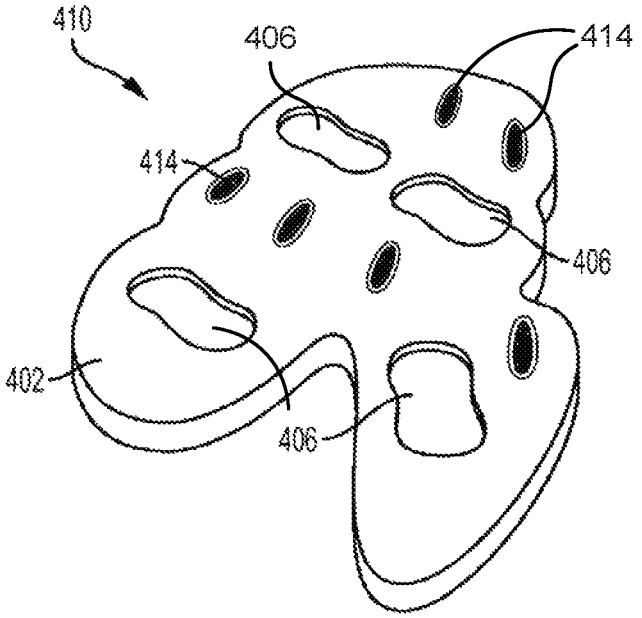
FIG. 11A shows a top perspective view of one aspect of a forefoot stabilizer plug according to the present disclosure.
Figure 11B:
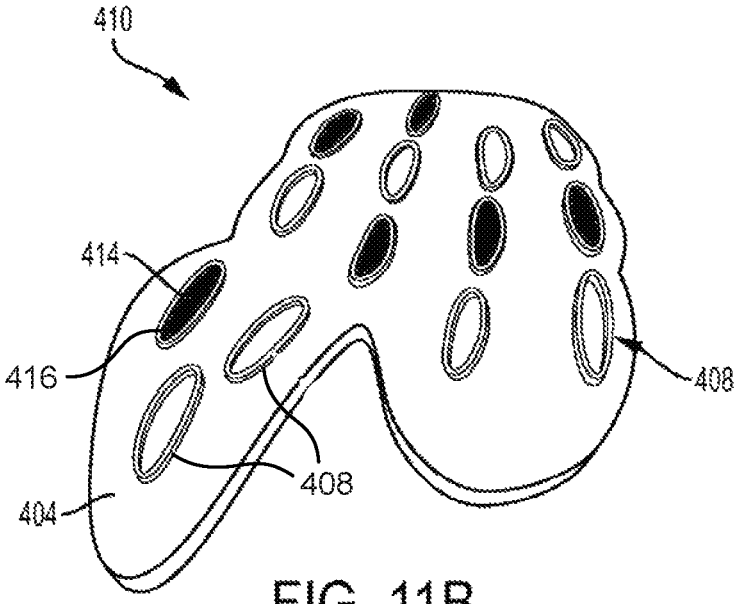
FIG. 11B shows a bottom perspective view of the forefoot stabilizer plug of FIG. 11A.
Figure 11C:
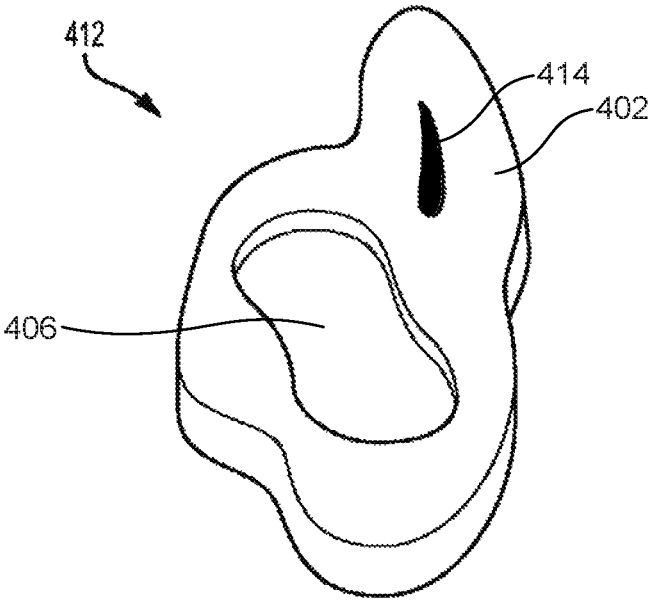
FIG. 11C shows a top perspective view of a heel stabilizer plug according to the present disclosure.
Figure 11D:
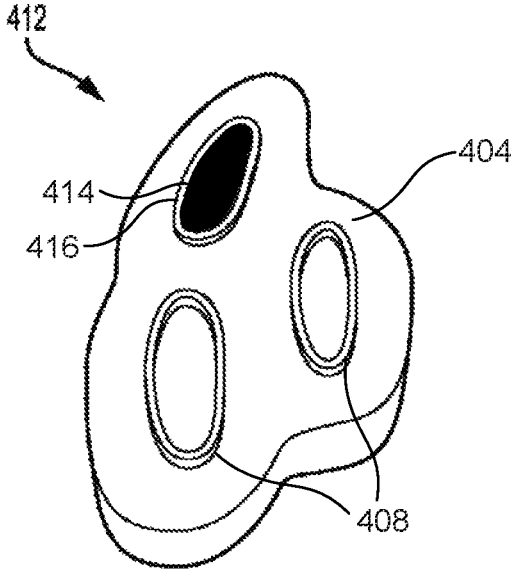
FIG. 11D shows a bottom perspective view of the heel stabilizer plug of FIG. 11C.
Figure 12A:
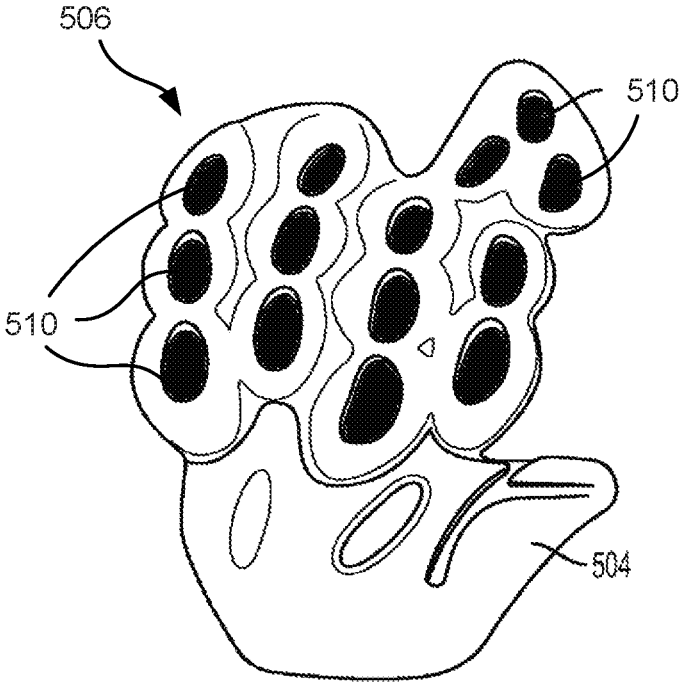
FIG. 12A shows a bottom view of the forefoot outsole member.
Figure 12B:
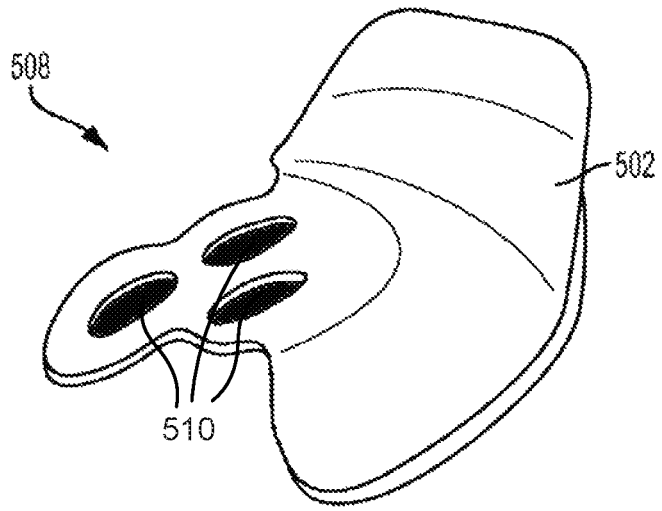
FIG. 12B shows a top perspective view of a heel outsole member according to the present disclosure.
Figure 12C:
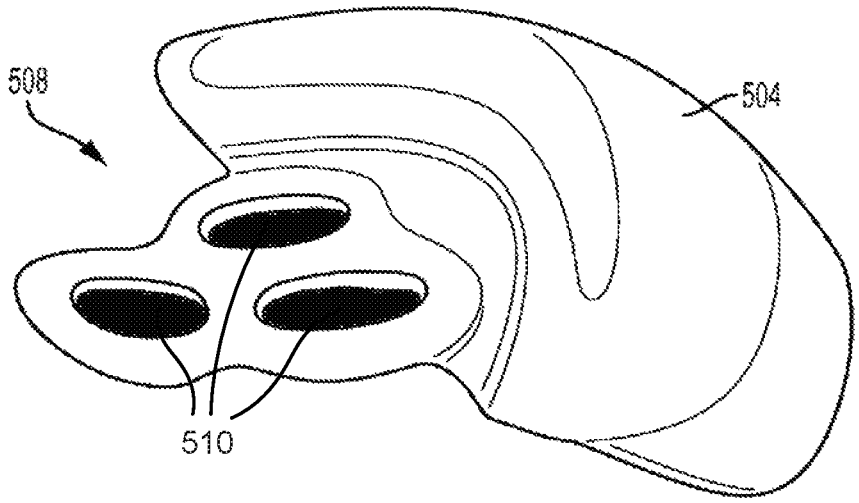
FIG. 12C shows a bottom perspective view of the heel outsole member of FIG. 12B.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. To this end, those skilled in the relevant art will recognize and appreciate that many changes can be made to the various aspects of the invention described herein, while still obtaining the beneficial results described herein. It will also be apparent that some of the desired benefits described herein can be obtained by selecting some of the features described herein without utilizing other features. Accordingly, those who work in the art will recognize that many modifications and adaptations to the present invention are possible and can even be desirable in certain circumstances and are a part described herein. Thus, the following description is provided as illustrative of the principles described herein and not in limitation thereof.

Reference will be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects of shoe construction and manufacture have not been described in particular detail in order to avoid unnecessarily obscuring aspects of the disclosed implementations.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal aspect. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be predefined it is understood that each of these additional steps can be predefined with any specific aspect or combination of aspects of the disclosed methods.

Reference will now be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

Turning now to FIGS. 1-7, an implementation of one exemplary aspect of an athletic shoe having a trampoline-effect energy return system is illustrated. In one aspect, the shoe 100 comprises a shoe sole assembly 102 and a shoe upper assembly 104. In another aspect, the shoe upper assembly can comprise a lightweight, supportive, breathable mesh 106 secured with panels 108 to reinforce portions of each of the heel, toe and sides of the shoe. In one aspect, the panels can comprise, for example and without limitation, natural leather, synthetic leather, canvas, rubber, plastic and the like. In another aspect, a plurality of support straps 110 extend upwardly from the base or near the base of the shoe along each side to a central, foot-receiving portion 112 of the shoe upper assembly. In a further aspect, the plurality of support straps are secured with a securing means 114 such as, for example and without limitation, a lace, a strap and the like.

In another aspect and as illustrated in FIGS. 8-12C, the shoe sole assembly 200 can comprise a midsole 300, at least one stabilizer plug 400, and at least one outsole member 500. Here, the midsole 300 has an upper midsole surface 302, a lower midsole surface 304, a midsole forefoot portion 306 and a midsole heel portion 308. In another aspect, the at least one stabilizer plug 400 has an upper stabilizer plug surface 402, a lower stabilizer plug surface 404, and at least one trampoline recess 406 disposed in the upper stabilizer plug surface. In another aspect, the stabilizer plug can have at least one projection 408 extending outwardly from the lower stabilizer plug surface relative to the vertical axis 202 of the shoe sole assembly and, in a further aspect, each projection 408 of the at least one projection can substantially underlie at least a portion of the at least one trampoline recess 406.

In another aspect, the lower midsole surface 304 can define at least one stabilizer plug recess 310 sized and shaped to receive a corresponding at least one stabilizer plug 400.

In another aspect, the at least one outsole member 500 has an upper outsole surface 502 and a lower outsole surface 504. In another aspect, the at least one outsole member can be adapted to complementarily receive the at least one projection 408 of a corresponding stabilizer plug 400.

In operation, when a force is applied to the lower outsole surface 504 during a foot strike, the at least one trampoline recess 406 can receive underlying portions of the stabilizer plug 400 to accommodate elastic deformation of the underlying portions of the stabilizer plug 400 and the outsole member 500 relative to the vertical axis 202. Then, as one skilled in the art will appreciate in light of the present disclosure, the underlying portions of the stabilizer plug and the outsole member will exert a force against the ground as they return to their respective neutral states.

In other aspects, the at least one stabilizer plug 400 can comprise at least one of a forefoot stabilizer plug 410 and a heel stabilizer plug 412. In another aspect, the at least one outsole member 500 can comprise at least one of a forefoot outsole member 506 and a heel outsole member 508.

In other aspects, the at least one trampoline recess 406 of the stabilizer plug 400 can have a selected cross-sectional shape relative to the vertical axis 202 of the shoe sole assembly 200. In light of the present disclosure, one skilled in the art will appreciate that the selected cross-sectional shape can be, for example, a circle, an oval, any regular or irregular polygon, a diamond, a peanut, a trefoil, a quatrefoil, a teardrop, one or a series of arcuate portions, any irregular cross-section and the like.

In yet other aspects, the at least one projection 408 of the stabilizer plug 400 can have a selected cross-sectional shape relative to the vertical axis 202 of the shoe sole assembly. In other aspects, the at least one projection 408 of the stabilizer plug 400 can comprise a circumferential projection circumscribing a selected shape relative to the vertical axis 202. In light of the present disclosure, one skilled in the art will appreciate that the selected cross-sectional shape can be, for example, a circle, an oval, any regular or irregular polygon, a diamond, a peanut, a trefoil, a quatrefoil, a teardrop, one or a series of arcuate portions, any irregular cross-section and the like.

In other aspects, the at least one projection 408 of the stabilizer plug 400 can comprise a first at least one projection. In this aspect, the at least one stabilizer plug further comprises at least one bore 414 extending from the upper stabilizer plug surface 402 to the lower stabilizer plug surface 404. In another aspect, the at least one outsole member 500 can comprise at least one bore 510 extending from the upper outsole surface 502 to the lower outsole surface 504. It is further contemplated that each of the at least one bore 414 of the stabilizer plug 400 is coextensive with the at least one bore 510 of the outsole member 500. In a further aspect, a the stabilizer plug 400 can comprise a second at least one projection 416 extending outwardly from the lower stabilizer plug surface 404 relative to the vertical axis 202 and the second at least one projection can be complementarily received within a corresponding bore of the outsole member. In light of the present disclosure, one skilled in the art will appreciate that providing at least one bore 414 and at least one bore 510 can serve to decrease the weight of the shoe sole assembly 200.

In other aspects, the midsole 300 can comprise a polymer, and, more particularly, a thermoplastic material. In other aspects, the stabilizer plug 400 can comprise a polymer, and, more particularly, a thermoplastic material. In one exemplary aspect with reference to either the midsole 300 or the stabilizer plug 400, the thermoplastic material comprises ethylene-vinyl acetate (EVA). As used throughout this disclosure, any reference to EVA should be construed to include poly-ethylene-vinyl acetate (PEVA).

In other aspects, the stabilizer plug 400 comprises a material having a higher durometer than the material comprising the midsole 300. In one exemplary aspect, the material comprising the stabilizer plug 400 has a durometer of from about 5 to about 15 Shore higher than the material comprising the midsole 300. In other aspects, the material comprising the midsole 300 can be selected to have a Shore C durometer of from about 50 to about 60. In other aspects, the material comprising the midsole 300 can be selected to have a Shore C durometer of about 55 and have a tolerance of about +/−3 durometer. In other aspects, the material comprising the stabilizer plug 400 can be selected to have a Shore C durometer of from about 60 to about 70. In other aspects, the material comprising the stabilizer plug 400 can be selected to have a Shore C durometer of about 65 and have a tolerance of about +/−3 durometer.

Figure 13:
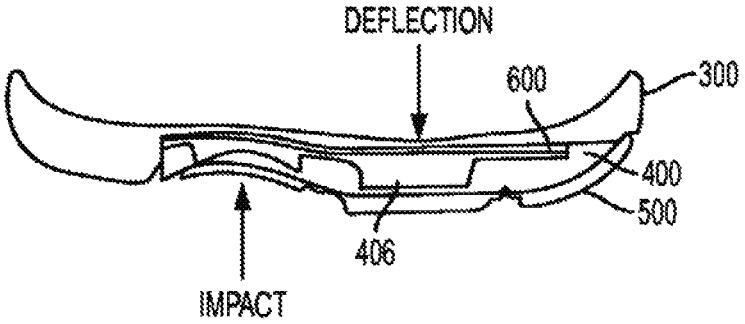
FIG. 13 shows a perspective, exploded view of another aspect of a shoe sole assembly according to the present disclosure.

In another aspect illustrated in FIG. 13, an additional contoured plate 600 can be disposed between the midsole 300 and the stabilizer plug 400. Here, it is contemplated that the additional contoured plate can comprise a durometer greater than the stabilizer plug 400. In an optional aspect, the contoured plate can have a concavity relative to the outsole 500 and the vertical axis 202. It is further contemplated that, in operation, the contoured plate 600 can enhance the energy displacement of the stabilizer plug 400, for example, by forcing the sides of the trampoline void 406 to collapse into the trampoline void upon a foot strike.

Figure 14A:
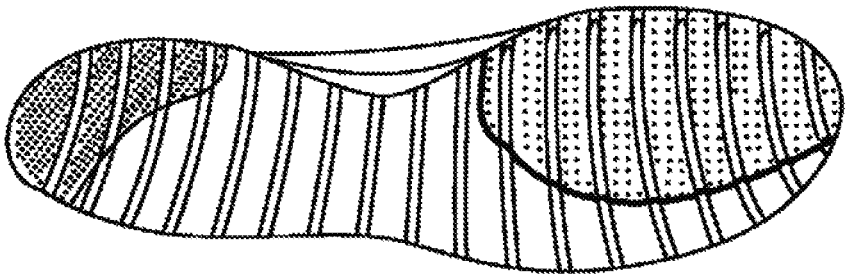
FIG. 14A shows a bottom view of another aspect of a shoe sole assembly according to the present disclosure.
Figure 14B:
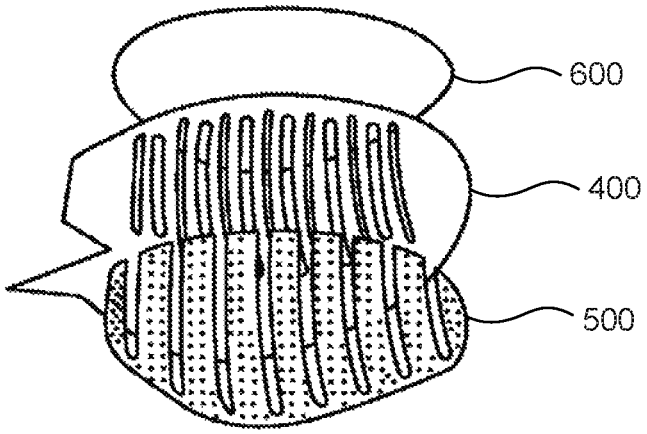
FIG. 14B shows a perspective, exploded view of the shoe sole assembly of FIG. 14A.

In another aspect illustrated in FIGS. 14A-14B, another aspect of the present disclosure is provided where linear voids adapted to work with the natural flexing of the foot during at least one of walking, running, and jumping are provided.

Figure 15A:
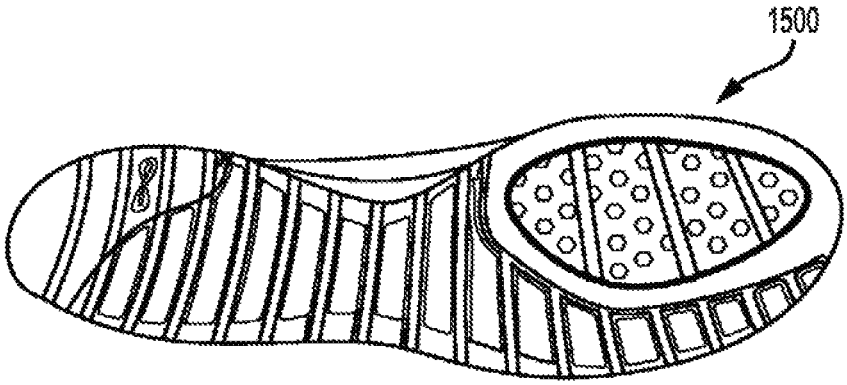
FIG. 15A shows a bottom view of another aspect of a shoe sole assembly according to the present disclosure.
Figure 15B:
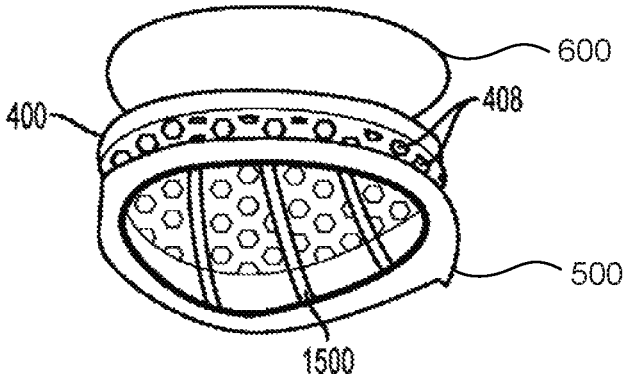
FIG. 15B shows a perspective, exploded view of the shoe sole assembly of FIG. 15A.

In another aspect illustrated in FIGS. 15A-15B, another aspect of the present disclosure is provided having a more even distribution of the impact forces upon a foot strike. Here, the outsole design comprises vertically-extending linear members 1500 adapted to complementarily receive a plurality of projections 408 of a corresponding stabilizer plug 400.

Figure 16A:
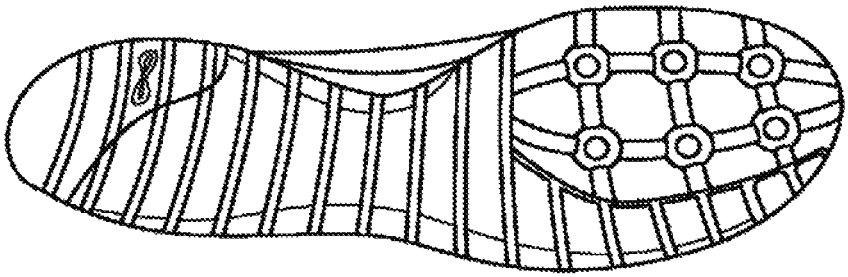
FIG. 16A shows a bottom view of another aspect of a shoe sole assembly according to the present disclosure.
Figure 16B:
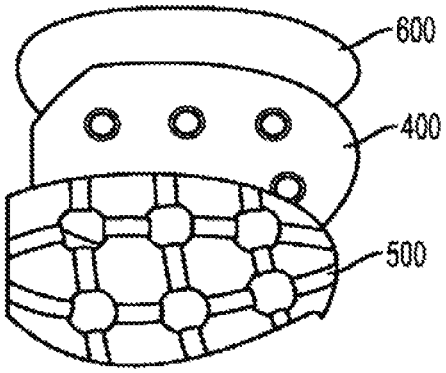
FIG. 16B shows a perspective, exploded view of the shoe sole assembly of FIG. 16A.
Figure 16C:
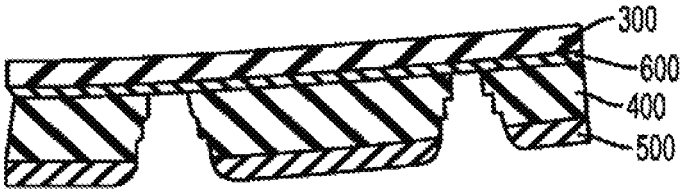
FIG. 16C shows a cross-sectional view of the shoe sole assembly of FIG. 16A.

In another aspect illustrated in FIGS. 16A-16B, another aspect of the present disclosure is provided wherein the additional contoured plate 600 acts as a primary trampoline surface and where voids provided in the combined stabilizer plug 400 and outsole 500 create energy return during foot strike. It is further contemplated that this functionality could be replicated at the heel, as well.

Figure 17A:
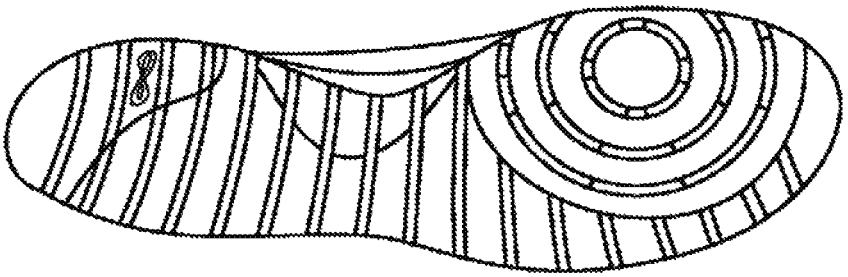
FIG. 17A shows a bottom view of another aspect of a shoe sole assembly according to the present disclosure.
Figure 17B:
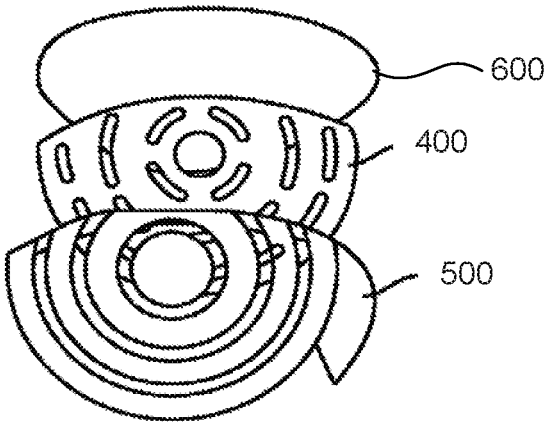
FIG. 17B shows a perspective, exploded view of the shoe sole assembly of FIG. 17A.

In another aspect illustrated in FIGS. 17A-17B, another aspect of the present disclosure is provided wherein the stabilizer plug 400 comprises a plurality of arcuate recessed portions that circumscribe an impact zone. It is further contemplated that this functionality could be replicated at the heel, as well.

Figure 18A:
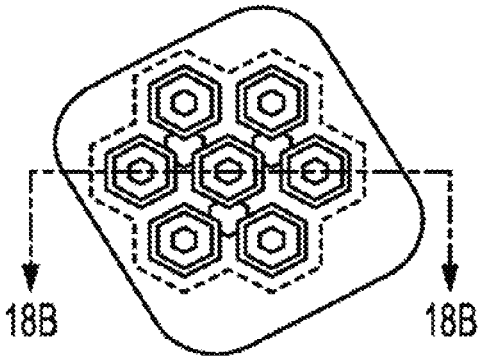
FIG. 18A shows a top view of another aspect of a shoe sole assembly according to the present disclosure.
Figure 18B:
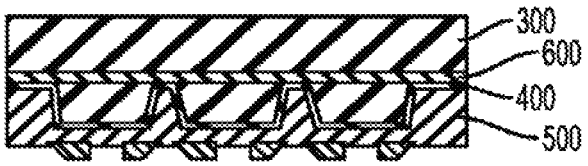
FIG. 18B shows a cross-sectional view of the shoe sole assembly of FIG. 18A.

In another aspect illustrated in FIGS. 18A-18B, another aspect of the present invention comprises an assembly 700 comprising a contoured plate 600, a stabilizer plate 400 and an outsole member 500.

Figure 19A:
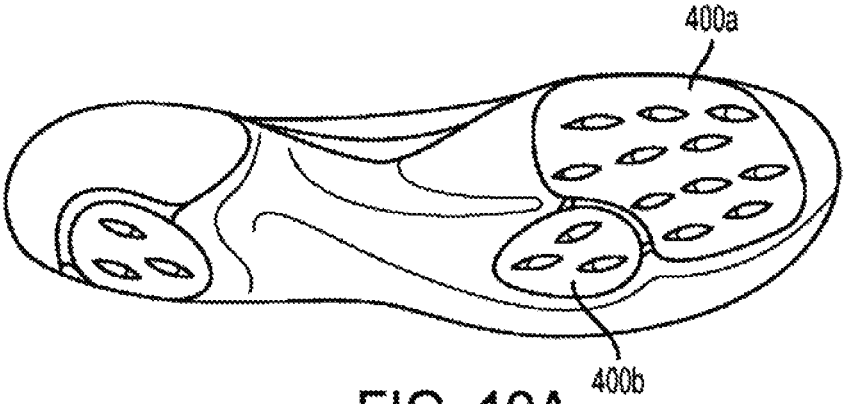
FIG. 19A shows a bottom view of another aspect of a shoe sole assembly according to the present disclosure.
Figure 19B:
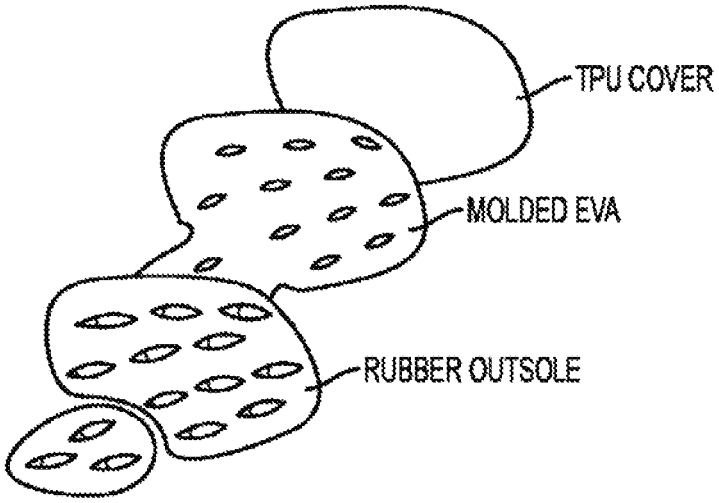
FIG. 19B shows a perspective, exploded view of the shoe sole assembly of FIG. 19A.
Figure 20A:
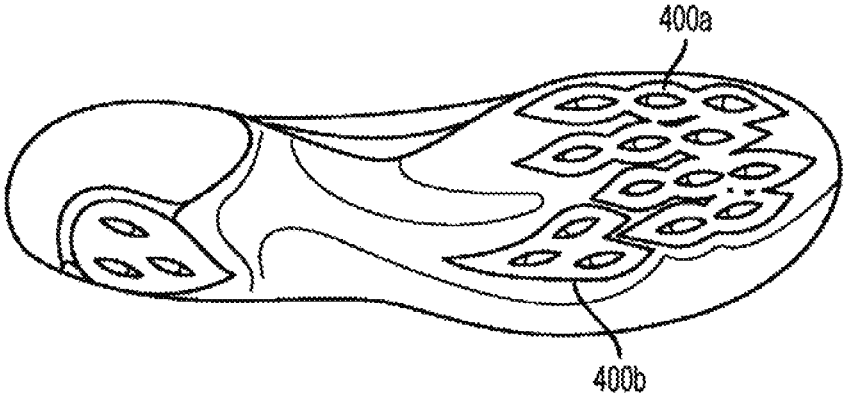
FIG. 20A shows a bottom view of another aspect of a shoe sole assembly according to the present disclosure.
Figure 20B:
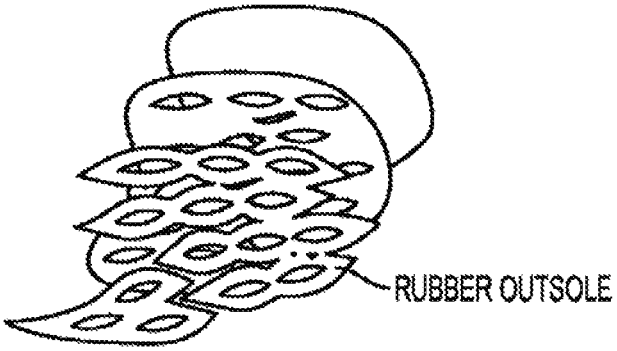
FIG. 20B shows a perspective, exploded view of the shoe sole assembly of FIG. 20A.

In another aspect illustrated in FIGS. 19A-19B, another aspect of the present disclosure is provided wherein the at least one stabilizer plug 400 comprises two forefoot stabilizer plugs. The distance provided between the first stabilizer plug 400*a* and the second stabilizer plug 400*b* can at least one of reduce weight and allow the smaller stabilizer plug 400*b* to function independently of stabilizer plug 400*a*. In another aspect illustrated in FIGS. 20A-20B, the aspect illustrated in FIGS. 19A-19B is shown but where the outsole member has been reduced down to the bare minimum necessary to contact with the ground upon a foot strike. It is further contemplated that this functionality could be replicated at the heel, as well.

Accordingly, FIGS. 1-20B and the corresponding text provide a number of different components and mechanisms for providing an athletic shoe having an energy return system. In addition to the foregoing, implementations described herein can also be described in terms acts and steps in a method for accomplishing a particular result. For example, a method for manufacturing an athletic shoe having an energy return system is described with reference to the components and diagrams of FIGS. 1-20B.

The present invention can thus be embodied in other specific forms without departing from its spirit or essential characteristics. The described aspects are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A shoe sole assembly having a vertical axis extending therethrough, comprising:

a midsole having an upper midsole surface, a lower midsole surface, a midsole forefoot portion, and a midsole heel portion;

at least one stabilizer plug having an upper stabilizer plug surface, a lower stabilizer plug surface, at least one trampoline recess disposed in the upper stabilizer plug surface, and at least one projection extending outwardly from the lower stabilizer plug surface relative to the vertical axis, wherein the at least one trampoline recess does not protrude the lower stabilizer plug surface and each projection of the at least one projection substantially underlies at least a portion of the at least one trampoline recess; and at least one outsole member having an upper outsole surface and a lower outsole surface, wherein the upper outsole surface of each outsole member is adapted to complementarily receive the at least one projection of a corresponding stabilizer plug;

wherein the lower midsole surface defines at least one stabilizer plug recess, wherein each of the at least one stabilizer plug recesses is sized and shaped to receive a corresponding stabilizer plug of the at least one stabilizer plug; and wherein, when a force is applied to the lower outsole surface during a foot strike, the at least one trampoline recess receives underlying portions of the stabilizer plug to accommodate elastic deformation of the underlying portions of the stabilizer plug and the outsole member relative to the vertical axis.

2. The shoe sole assembly of claim 1, wherein the at least one projection has a selected cross-sectional shape relative to the vertical axis of the shoe sole assembly.

3. The shoe sole assembly of claim 1, wherein the at least one stabilizer plug comprises at least one forefoot stabilizer plug.

4. The shoe sole assembly of claim 1, wherein the at least one stabilizer plug comprises a heel stabilizer plug.

5. The shoe sole assembly of claim 1, wherein the at least one stabilizer plug comprises a first stabilizer plug and a second stabilizer plug, wherein the first stabilizer plug is a forefoot stabilizer plug and the second stabilizer plug is a heel stabilizer plug.

6. The shoe sole assembly of claim 1, wherein the midsole comprises a thermoplastic material.

7. The shoe sole assembly of claim 6, wherein the thermoplastic material comprises ethylene-vinyl acetate.

8. The shoe sole assembly of claim 1, wherein the at least one stabilizer plug comprises a thermoplastic material.

9. The shoe sole assembly of claim 8, wherein the thermoplastic material comprises ethylene-vinyl acetate.

10. The shoe sole assembly of claim 1, wherein the midsole has a Shore C durometer of from about 50 to about 60 Shore.

11. The shoe sole assembly of claim 1, wherein the midsole has a Shore C durometer of about 55 Shore and a tolerance of about +/−3 Shore.

12. The shoe sole assembly of claim 1, wherein the at least one stabilizer plug has a Shore C durometer of from about 60 to about 70 Shore.

13. The shoe sole assembly of claim 1, wherein the at least one stabilizer plug has a Shore C durometer of about 65 Shore and a tolerance of about +/−3 Shore.

14. The shoe sole assembly of claim 1, wherein the at least one stabilizer plug further comprises at least one bore extending from the upper stabilizer plug surface to the lower stabilizer plug surface.

15. The shoe sole assembly of claim 14, wherein the at least one outsole member comprises at least one bore extending from the upper outsole surface to the lower outsole surface and wherein the at least one bore of the stabilizer plug is substantially coextensive with the at least one bore of the outsole member.

16. The shoe sole assembly of claim 15, wherein the at least one projection of the stabilizer plug is a first at least one projection, wherein the stabilizer plug further comprises a second at least one projection extending outwardly from the lower stabilizer plug surface relative to the vertical axis circumscribing a perimeter of the at least one bore, wherein the second at least one projection is complementarily received within a corresponding bore of the outsole member.

17. The shoe sole assembly of claim 1, further comprising, a shoe upper assembly having a bottom portion that is attached to the shoe sole assembly and extends upward to a central, foot-receiving portion.

18. The shoe sole assembly of claim 17, wherein the shoe upper assembly further comprises a plurality of support straps extending upwardly from the shoe sole assembly to the central, foot-receiving portion.

19. The shoe sole assembly of claim 18, wherein the support straps are secured with a securing means.

* * * * *